US007451077B1

(12) United States Patent
Lindau et al.

(10) Patent No.: US 7,451,077 B1
(45) Date of Patent: Nov. 11, 2008

(54) ACOUSTIC PRESENTATION SYSTEM AND METHOD

(76) Inventors: Felicia Lindau, 3870 25th St., San Francisco, CA (US) 94114; Chuck Wooters, 320 Coronado St., El Cerrito, CA (US) 94530; James Beck, 698 Vincente Ave., Berkeley, CA (US) 94707

( * ) Notice: Subject to any disclaimer, the term of this patent is extended or adjusted under 35 U.S.C. 154(b) by 721 days.

(21) Appl. No.: 10/711,526

(22) Filed: Sep. 23, 2004

(51) Int. Cl.
*G10L 19/00* (2006.01)

(52) U.S. Cl. ..... 704/200; 704/203; 381/306

(58) Field of Classification Search ..... 704/200, 704/203; 381/306
See application file for complete search history.

(56) References Cited

U.S. PATENT DOCUMENTS

| | | | | | |
|---|---|---|---|---|---|
| 3,222,574 | A | | 12/1965 | Silvestri, Jr. | 315/200 R |
| 4,000,679 | A | | 1/1977 | Norman | 84/464 |
| 4,216,464 | A | | 8/1980 | Terry | 340/321 |
| 4,265,159 | A | | 5/1981 | Liebman et al. | 84/464 |
| 4,358,754 | A | | 11/1982 | Young et al. | 340/815 |
| 4,440,059 | A | | 4/1984 | Hunter | 84/464 |
| 4,928,568 | A | | 5/1990 | Snavely | 84/464 |
| 5,111,113 | A | | 5/1992 | Chu | 315/210 |
| 5,121,435 | A | | 6/1992 | Chen | 381/56 |
| 5,402,702 | A | | 4/1995 | Hata | 84/464 |
| 5,461,188 | A | | 10/1995 | Drago et al. | 84/600 |
| 5,501,131 | A | | 3/1996 | Hata | 84/464 |
| 5,513,129 | A | * | 4/1996 | Bolas et al. | 703/13 |
| 5,896,457 | A | | 4/1999 | Tyrrel | 381/56 |
| 6,140,565 | A | * | 10/2000 | Yamauchi et al. | 84/600 |
| 6,151,577 | A | * | 11/2000 | Braun | 704/276 |
| 6,542,869 | B1 | | 4/2003 | Foote | 704/500 |
| 6,604,880 | B1 | | 8/2003 | Huang et al. | 401/195 |
| 7,157,638 | B1 | * | 1/2007 | Sitrick | 84/477 R |
| 7,215,782 | B2 | * | 5/2007 | Chen | 381/17 |
| 2005/0190199 | A1 | * | 9/2005 | Brown et al. | 345/600 |
| 2006/0063981 | A1 | * | 3/2006 | Sotos et al. | 600/301 |

OTHER PUBLICATIONS

McLeod et al. "Visualization of Muci Pitch" IEEE 2003.*
Beth Logan, Mel Frequency Cepstral Coefficients for Music Modeling, (2000), published on the Internet, http://ismir2000.ismir.net/papers/logan_paper.pdf.

* cited by examiner

*Primary Examiner*—Daniel D Abebe
(74) *Attorney, Agent, or Firm*—William Keyworth; Bill & Mary Lou Inc.

(57) ABSTRACT

Complex acoustic information, such as music, is presented as visual information or as movement of an object in a manner simulating the reception of the complex acoustic information by the human auditory system including a complexity of tempo, rhythms, intensity variation from highs to lows, and silences of the audio, providing a synchronicity with these characteristics. The acoustic information is processed by an acoustic human-like auditory transformation. The transformation may be varied depending on the presentation controlled by the device. The transformed signal is then applied to a tactile or visual presentation. The audience reception of the invention is through light, color, or animation of an image or object complementing the reception of the acoustic information.

19 Claims, 9 Drawing Sheets

ACOUSTIC PRESENTATION SYSTEM AND METHOD

CROSS-REFERENCE TO RELATED APPLICATIONS

Not Applicable.

STATEMENT REGARDING FEDERALLY SPONSORED RESEARCH AND DEVELOPMENT

Not Applicable.

BACKGROUND OF THE INVENTION

1. Field of the Invention

This invention is a device and method for presenting complex acoustic information, such as music, as visual or tactile information. The acoustic information is processed by a human-like auditory transformation simulating the processing of acoustic information by a human auditory system. The transformed signal is then applied to a tactile or visual presentation. The audience perception of the invention is visual through light, color, animation of an image or object, or touch by movement of an object, providing a synchronicity with the perception of the sound.

2. Description of Related Art

Devices that enhance the human experience of listening to music by expanding the senses used during the experience are popular. Live concerts generally feature motion from the movement of the musicians or an orchestra conductor to the gyrations of a rock band the motion provides an enhancement of the listening experience. The popularity of music video on television, and the popularity of dance are further examples of this combining of listening and motion or visual presentation.

Devices for transforming acoustic information into visual or motion output information are known in the art. In the simplest form these devices simply have a built-in musical tune and a corresponding lighting or color presentation. Examples are U.S. Pat. No. 4,265,159 (Liebman et al.), U.S. Pat. No. 5,461,188 (Drago et al.), U.S. Pat. No. 5,111,113 (Chu) and U.S. Pat. No. 6,604,880 (Huang et al.). A more complex variation is devices that respond to the presence or absence of sound. Examples are U.S. Pat. Nos. 4,216,454 (Terry), 4,358,754 (Young et al.), 5,121,435 (Chen). Even more complex, is an example that responds to the intensity of the sound field as described in U.S. Pat. No. 4,440,059 (Hunter).

The circuitry for devices with multiple channels of output use varying forms of electronic circuits to capture the acoustical signal, convert it to an electronic signal, and then divide that signal into non-overlapping frequency bands and drive the presentation device by the signal in a desired frequency band or in multiple bands. Examples of such devices providing a multi-channel light signal in response to the music are in U.S. Pat. Nos. 3,222,574 (Silvestri, Jr.), 4,000,679 (Norman) 4,928,568 (Snavely), 5,402,702 (Hata) and 5,501,131 (Hata). Another variation is to take two channels of sound, as is found in stereophonic music signals, and compare the two channels to produce a visual presentation, as taught in U.S. Pat. No. 5,896,457 (Tyrrel). All of these devices work by taking a measurable feature of the sound and using it to provide a presentation of the measurable feature.

Human perception of sound waves (also called sounds in this application) is subjective and is not only a physiological question of features of the ear, but also a psychological issue.

For example, there are masking effects that determine if a sound is perceived. A normally audible sound can be masked by another sound. A loud sound will mask a soft sound so that the soft sound is inaudible in the presence of the louder sound. If the sounds are close in frequency the soft sound is more easily masked than if they are far apart in frequency. A soft sound emitted soon after the end of a loud sound is masked by the loud sound, and even the soft sound received just before a loud sound can be masked. Sounds also have many different qualities that the human auditory system can perceive such as tempo, rhythms, intensity variation from highs to lows, and rests of silence.

A visual or tactile presentation that is not representative of the perceived sound does not enhance the audio experience. It instead provides a distraction to the audio experience. On the other hand, if the presentation enhances the audio by responding as the audio is perceived, it enhances the audio experience enabling the audience to visually or tactilly experience the tempo, rhythms, intensity variation from highs to lows, and silences of the audio, providing a synchronicity that enriches the combined experience more than either experience individually.

In order to provide a presentation which is representative of the perceived sound, it is necessary to model what humans actually hear. The presentation must represent how sounds are received and mapped into thoughts in the brain, rather than a mere representation of a measurable feature of the sound wave. The presentation also must be capable of displaying a wide range of values representing the wide range of perceptions of sound that human hearing is capable of. What is needed is a presentation that overcomes the limitations of the prior art by seemingly displaying responses to sounds as they occur and reflecting the richness of perceptible components of the sounds such as tempo, rhythms, intensity variation from highs to lows, and silences of the audio, providing a synchronicity with these characteristics.

SUMMARY OF THE INVENTION

This invention is a method and system for providing an audience sound and a visual or tactile presentation that expresses a rich interpretation of acoustic sound, perceived simultaneous with that sound. The method provides for receiving an acoustic signal then performing a human-like auditory transformation of the signal such that the signal has multiple channels reflecting such perceptible qualities as tone, notes, intensities, rhythms and harmonics. A time-sequence scaling of the transformed signals is performed to provide consistency of the presentation, and audience presentation of the transformed signal is provided such that it is perceived simultaneous with the perception of the sound.

The system creates an electronic sound signal from sound waves captured via a microphone, processes the signal with an automatic gain control (AGC) circuit, and converts the analog sound signal to a digital signal using an analog to digital (A/D) circuit. This signal is provided to a processor instructed to perform a human-like auditory transformation on the digital signal such that a multi-channel digital signal representative of human perception of the sound is created. The processor is further instructed to perform a time-sequence scaling of each channel of the multi-channel digital signal to maintain consistency of each signal. These signals are provided to a presentation that uses a multi-channel digital to analog (D/A) circuit to convert the signals, and these analog signals drive a visual or tactile presentation control. The control activates the display such that the presentation provides the audience a visual or tactile presentation of the sound representative of the perception of the sound including characteristics such as tempo, rhythms, intensity variation from highs to lows, and silences of the audio. The system performs the sound signal transformation quickly so the visual or tactile presentation is perceived with the perception of the sound, providing a synchronicity with the sound.

The human-like auditory transformation is made using a human hearing model selected for the presentation desired. Commonly used models are critical bands, mel scale, bark scale, equivalent rectangular bandwidth, and just noticeable difference.

The system may also use analog or digital stored sound signals to produce both the sound and the visual or tactile presentation of the sound. In use with music, the system may also develop an estimate of the music beat. This signal is added to one or more of the visual or tactile presentation channels to enhance the presentation. Types of displays used for the presentation may include multiple channels of lights, multiple color lights, an animated display on a computer or television screen, or projection of the animated display, fountains of water, multiple channels of laser lights, multiple spotlights, motion of an object in multiple degrees of freedom, multiple firework devices, a refreshable Braille display, or vibrating surfaces.

The system may be implemented on an Application Specific Integrated Circuit (ASIC) or a general-purpose computer system, or any other type of digital circuitry that can perform the computer-executable instructions described.

OBJECTS AND ADVANTAGES

One object of this invention is to provide a visual presentation representative of the human perception of sound such that the human may watch the presentation change with the perception of the sound.

A second object of this invention is to provide motion of an object representative of the human perception of sound such that the human may observe visually the object motion change with the perception of the sound, and/or observe tactilely the motion change with the perception of the sound.

BRIEF DESCRIPTION OF THE SEVERAL VIEWS OF THE DRAWINGS

A more complete understanding of the present invention can be obtained by considering the detailed description in conjunction with the accompanying drawings, in which.

REFERENCE NUMERALS IN DRAWINGS

Figure 1:
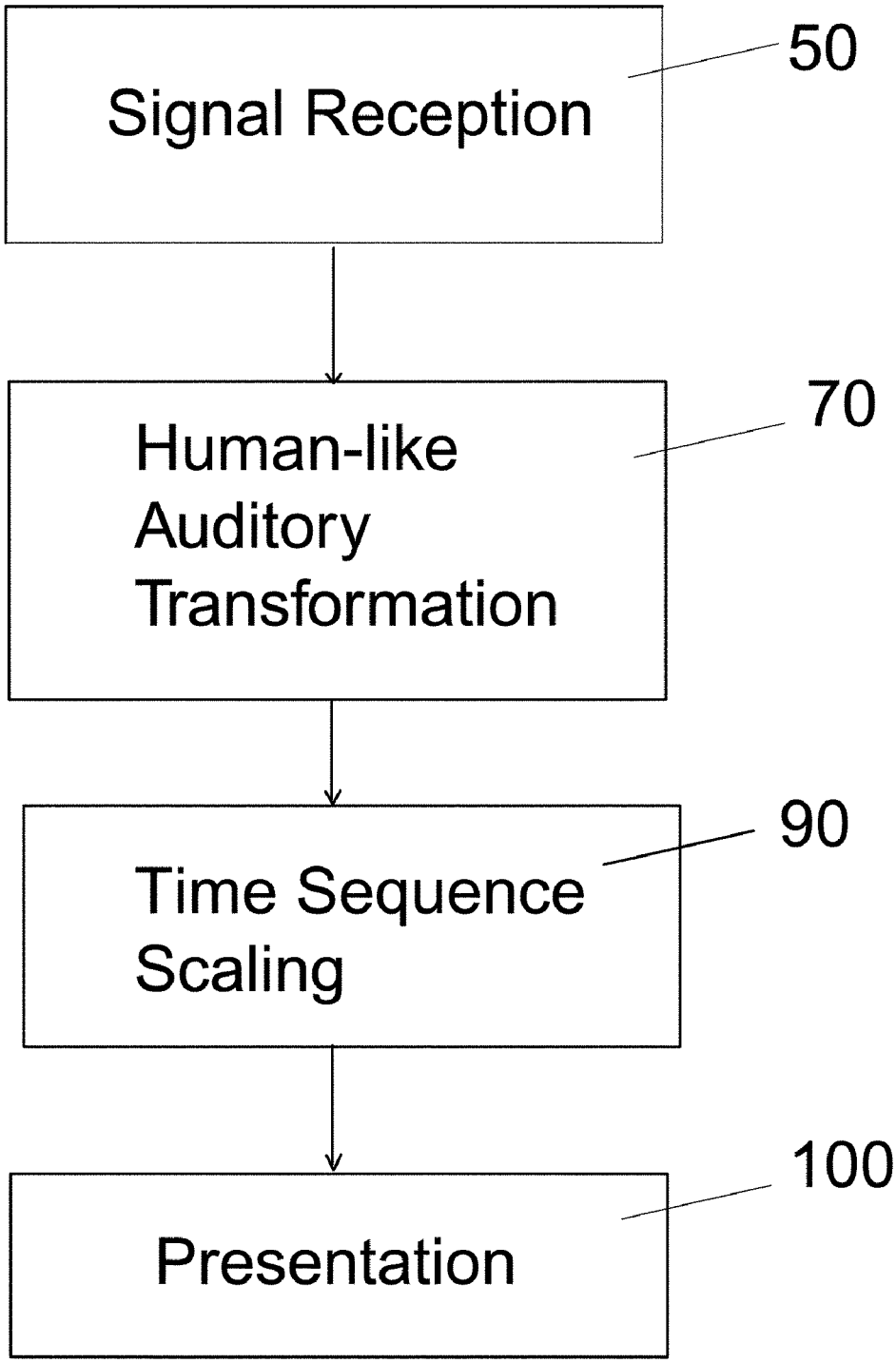
FIG. 1 is a block diagram of the acoustic presentation system showing the features of the device.

These reference numbers are used in the drawings to refer to areas or features of the invention.

40 Sound Source
50 Signal Reception
52 Microphone
54 AGC
56 A/D
58 Sound Storage Playback
60 Sound Presentation
70 Human-like Auditory Transformation
72 FFT
74 Human Hearing Model
80 Beat Detection
90 Time-Sequence Scaling
100 Presentation
102 Multichannel D/A
104 Presentation Controls
106 Presentation Display
120 Application Specific Integrated Circuit (ASIC)
122 Power Supply
124 Rectifier
140 Computer

DETAILED DESCRIPTION OF THE INVENTION

The present invention is an electronic device and a method of providing a visual or tactile presentation of an acoustic presentation, such as music, on a device to be observed, as the acoustic presentation is perceived. Referring to FIG. 1, The invention performs four functions, signal reception (50) is the receipt by the device of the acoustic presentation, human-like auditory transformation (70) is the changing of the signal into channels of acoustic frequency band energy vectors that represent the human perception of the acoustic presentation, time-sequence scaling (90) is the scaling of a time interval of the output presentation to the previous time interval to provide consistency of the presentation, and the presentation (100) is the display of multi-channel lights, colors of lights, display animation, or object animation that moves to display the acoustic presentation, and the controls and signal conditioning needed for the presentation display.

Figure 3A:
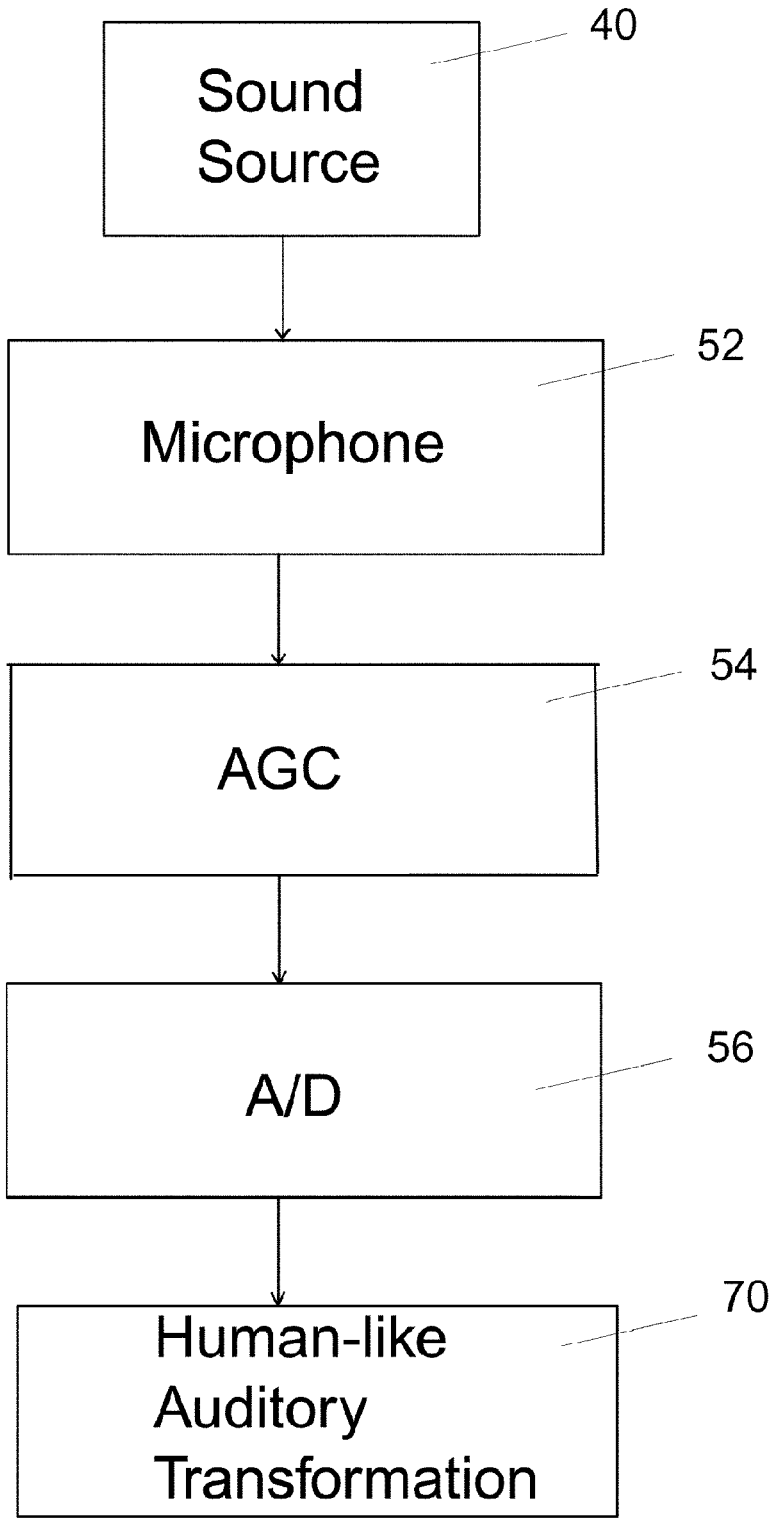
FIG. 3A is a block diagram of the signal reception feature of the device using an external sound source.

The signal reception (50) is a microphone (52) to convert the sounds coming from the sound source (40) to an electronic sound signal as shown in FIG. 3A. The signal is processed by the automatic gain control, AGC (54), to maintain the amplitude in a range that can be processed by the analog to digital converter, A/D (56). The digital signal is then provided to a digital processor for the human-like auditory transformation (70). The processor may be a general purpose computer, an Application Specific Integrated Circuit (ASIC), or any other type of digital circuitry that can perform the computer-executable instructions described herein.

Figure 4:
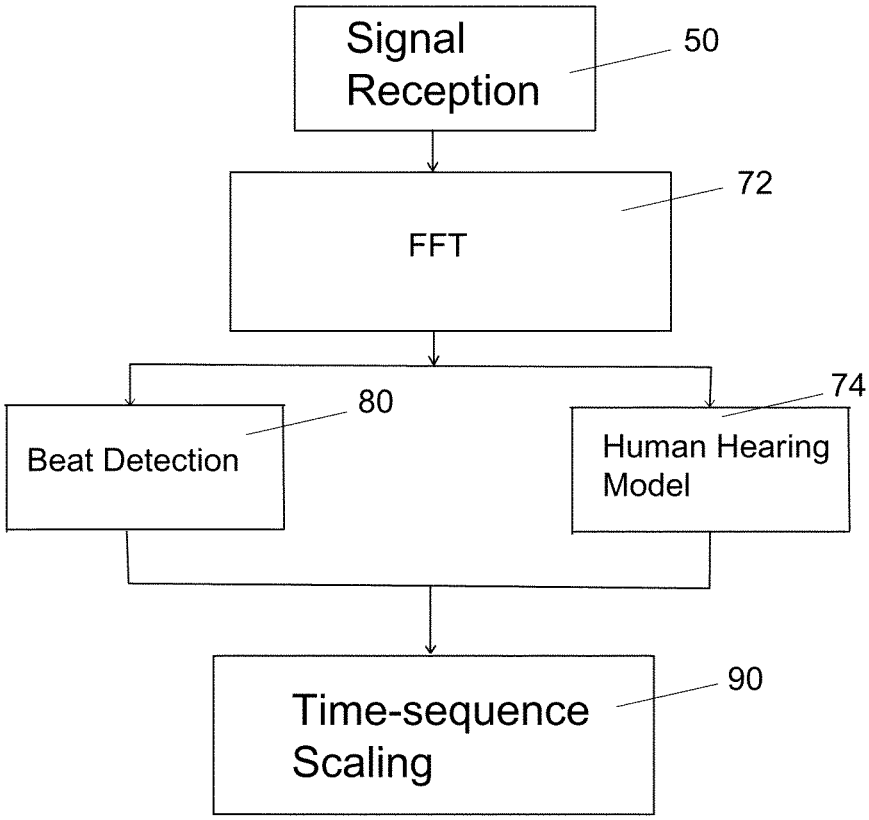
FIG. 4 is a block diagram of the human-like auditory transformation feature of the device.

The human-like auditory transformation (70) is shown in FIG. 4. The digital sound signal from the signal reception (50) is fed to the Fast Fourier Transform, FFT (72), which provides a Fourier spectrum frequency domain signal of the time-domain sound signal. The resulting frequency vectors are divided into channels weighted by the human hearing model (74).

Human hearing models (74) are based on studies of human acoustic perception and are known to those skilled in the art of computer voice recognition, where they are applied in modeling speech. Humans do not hear all frequencies the same, so the output of the FFT is combined into frequency bands by one of these models in a number of groups equaling the desired number of presentation channels. Any of several models may be used.

One such model is the critical band. Humans can hear frequencies in the range from 20 Hz to 20,000 Hz, however this range can be divided into experimentally derived critical bands that are non-uniform, non-linear, and dependent on the perceived sound. The critical bands are a series of experimentally derived frequency ranges in which two sounds in the same critical band frequency range are difficult to tell apart, in other words are perceived as one sound. Critical band ranges are used to weight the FFT spectrum of the sound and deliver these to the presentation (90). The number of channels desired for the presentation determines the number of groups.

An alternate model is the bark-scale. The bark scale corresponds to the first 24 critical bands of hearing and is often related to frequency (in hertz) by the relationship:

$$barks=13*\arctan(0.00076*f)+3.5*\arctan((f/7500)^2)$$

The bark scale may also be replaced with an Equivalent Rectangular Bandwidth (ERB) that decreases the band size of the bark scale at lower frequencies, below 500 Hz. The ERB was developed to account for the temporal analysis performed by the human brain on speech signals. The ERB is for moderate sound levels:

$$ERB=0.108f+24.7$$

Another model is the Just Noticeable Differences (jnd). The jnd provides band sizes based on the perception of changes in sound frequency, or pitch, that are perceived half the time. The jnd in hertz increases with the initial frequency in accordance with Weber's Law:

$$df/f=C$$

Still another alternate, the mel scale (m), is based on the perceived frequencies, or pitch, judged by listeners to be equal in distance one from another. It is related to frequency in hertz by the relationship:

$$m=1127.01048\log(1+f/700)$$

The signal may be further modified to emphasize the beat of the music as shown in FIG. 4. The beat detection (80) derives an estimate of the beat by summing the values for all the output levels of the FFT (72). This total energy value is scaled by determining the minimum and maximum values for the current and one previous time step. The minimum is subtracted from the maximum to derive the range of this short time period, and the range of desired output levels is divided by this range to provide a beat factor. The beat component is applied to the value of one or more channels of the human hearing model (74) output, depending on the type of presentation. Some presentations, such as a dancing doll, may not require this emphasis and so this feature may not be applied, or even calculated, in those cases.

The output of the human-like auditory transformation (70) is multiple channels of frequency domain energy values each in a range of desired output values. It is desired these values be in a desired range corresponding to the possible display states for the presentation that is used. These values may have been modified by the beat signal detection as previously described. This output, by channel, is stored in a memory for a time interval on the order of 1 second by the time-sequence scaling (90). This stored information, and the current value are used to derive a scale factor used to maintain the output value within the desired range. The range is calculated from the minimum and maximum of the stored and current time intervals. The desired range in output values for the presentation is divided by this calculated range to develop a scale factor that is applied to the current value.

Figure 2:
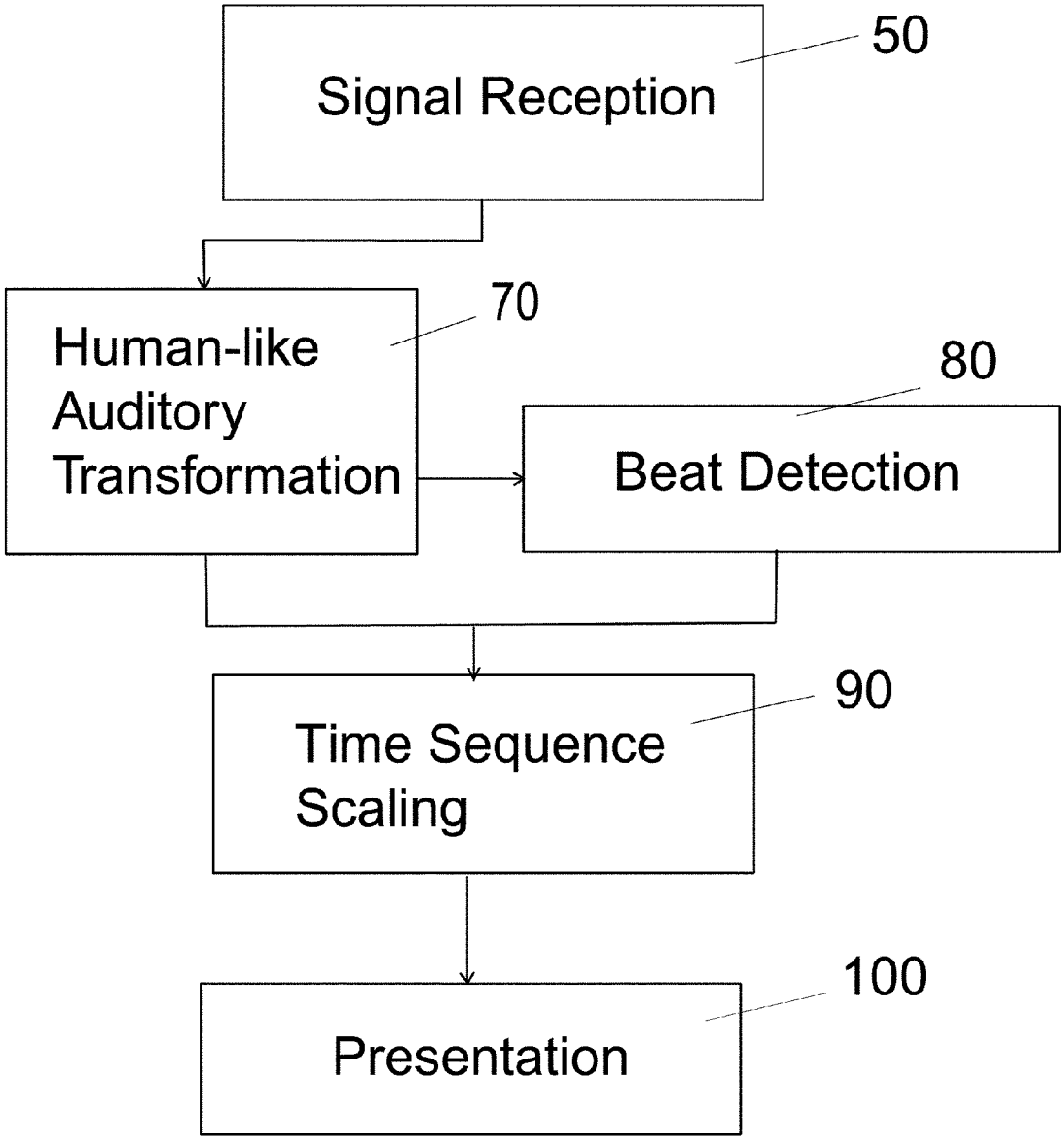
FIG. 2 is a block diagram of the acoustic presentation system showing an embodiment containing beat detection.
Figure 5:
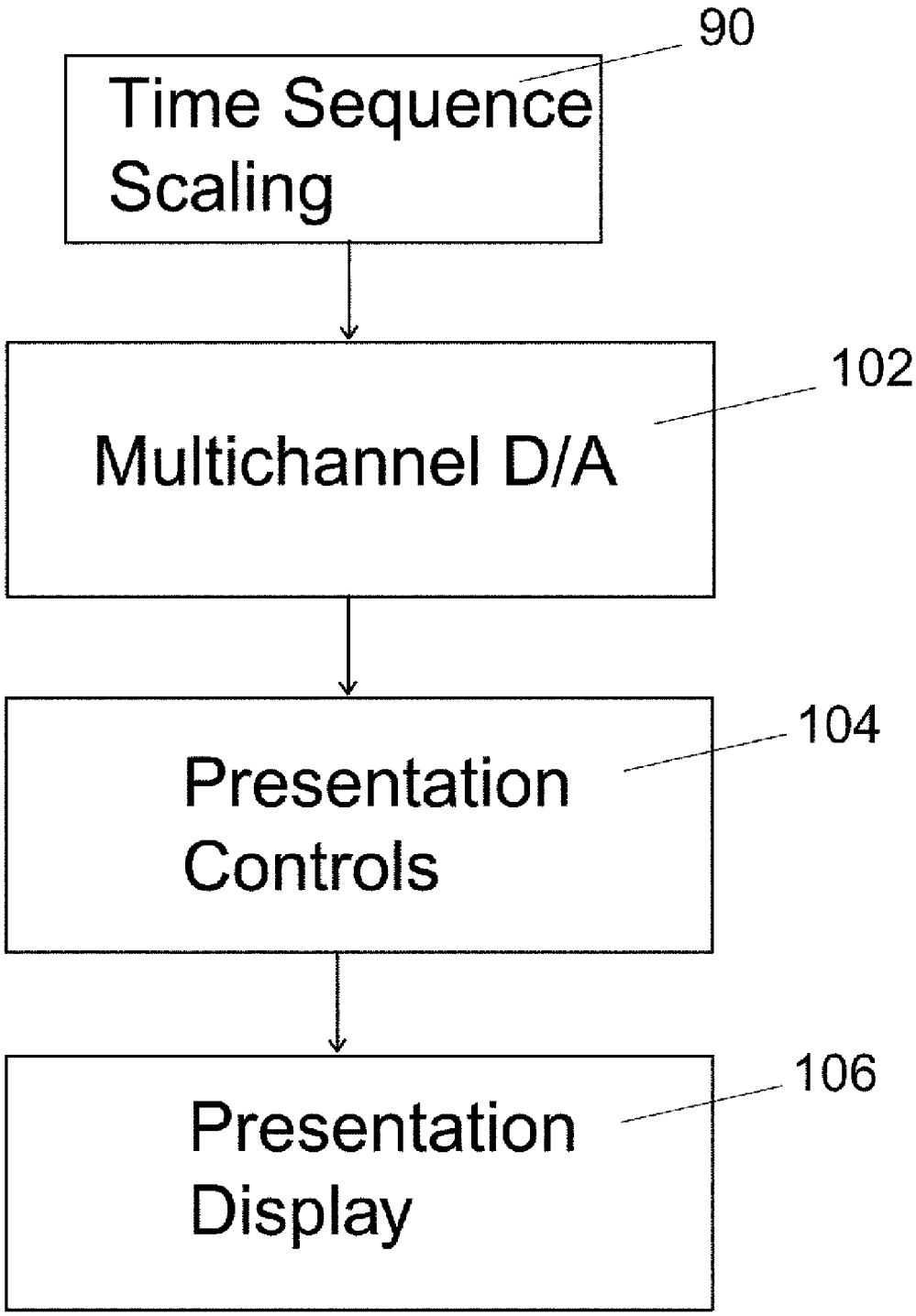
FIG. 5 is a block diagram of the presentation feature of the device.

The presentation (100) in FIGS. 1 and 2 is shown in FIG. 5. The multiple channel output from the time-sequence scaling (90) is converted by the multichannel D/A (102), digital to analog converter, to an analog signal for operating the presentation controls (104). Example presentation displays (106) that are commonly available include, but are not limited to, multiple channels of lights, multiple color lights, an animated display on a computer or television screen, or projection of the animated display, fountains of water, multiple channels of laser lights, multiple spotlights, motion of an object, such as a doll, in multiple degrees of freedom, multiple firework devices, a refreshable Braille display, vibrating surfaces, or other device providing visual or tactile information. The presentation controls (104) will vary depending on the type of display selected, but are commonly available for these displays. Power controls may be used for light strings and color displays to control brightness, image generation and motion generation circuits or software for video and computer displays, multiple motor controllers, solenoid valves, or igniters, for displays of motion of one or more objects or devices.

Figure 6:
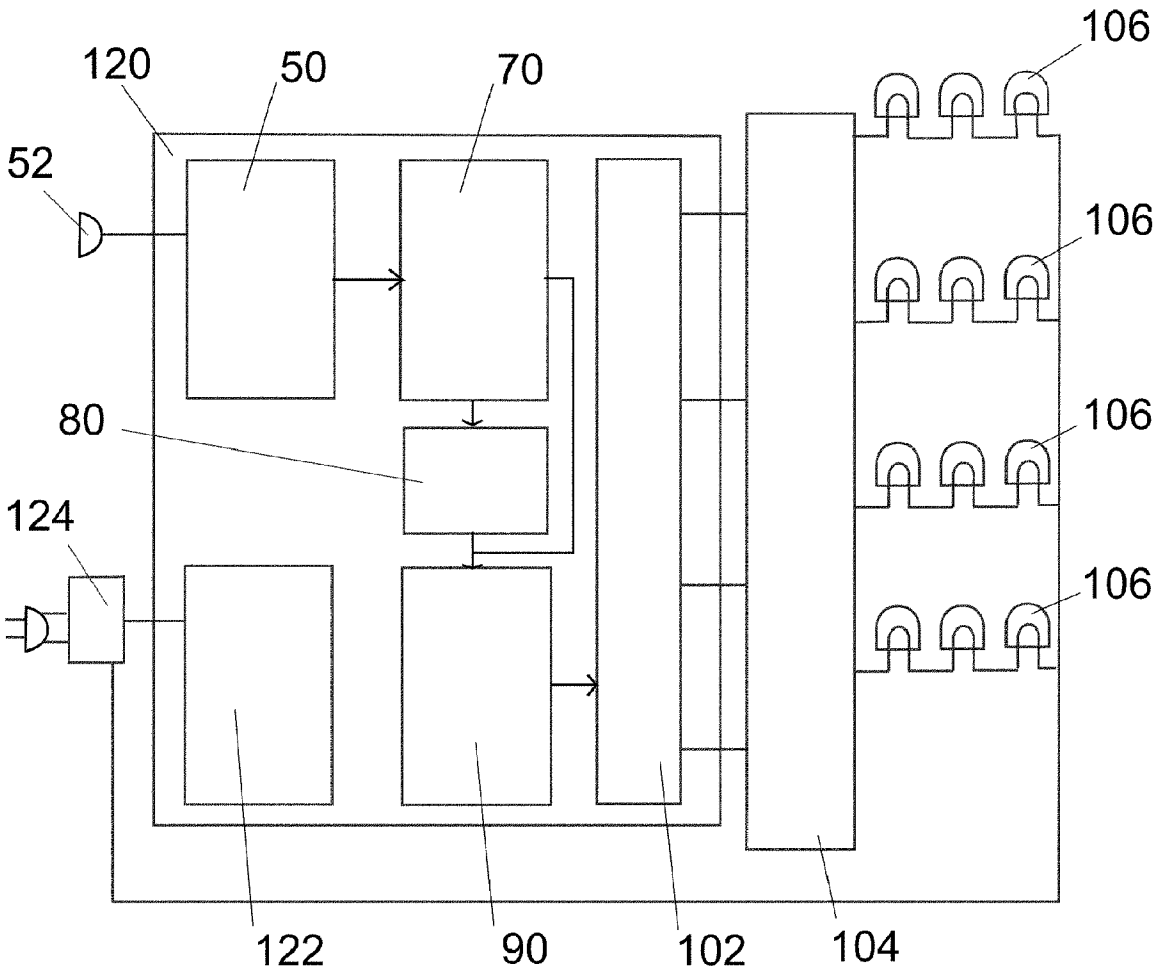
FIG. 6 is a schematic diagram of an implementation of the acoustic presentation system on an ASIC using strings of lights as the presentation.

One example of the present invention device is shown in FIG. 6. This is an Application Specific Integrated Circuit (120) or ASIC processor implementing the method of the present invention to provide a presentation display of multiple strings of lights (106). The ASIC and presentation are powered by the power supply (124) from an AC power source. A microphone is (52) incorporated into the device. The microphone sound signal is provided to the signal reception (50). Signal reception provides a digital signal as previously described to the human-like auditory transformation (70). Beat detection (80) is used for this presentation, and the results of both the human-like auditory transformation (70) and the beat detection (80) are a multi-channel signal with a range of up to 128 light intensity levels, maintained by the time-sequence scaling (90) as previously described.

The ASIC output signals are provided in digital form to the D/A (102) for powering the multiple strings of lights through the presentation controls (104), which control the power applied to the presentation. The resultant presentation is four channels of lighting strings responding in brightness to an acoustic presentation in the vicinity of the device. The four channels of lighting strings respond individually to the acoustic presentation, modeling the perception of the acoustic presentation as heard by the audience.

OTHER EMBODIMENTS

Figure 3B:
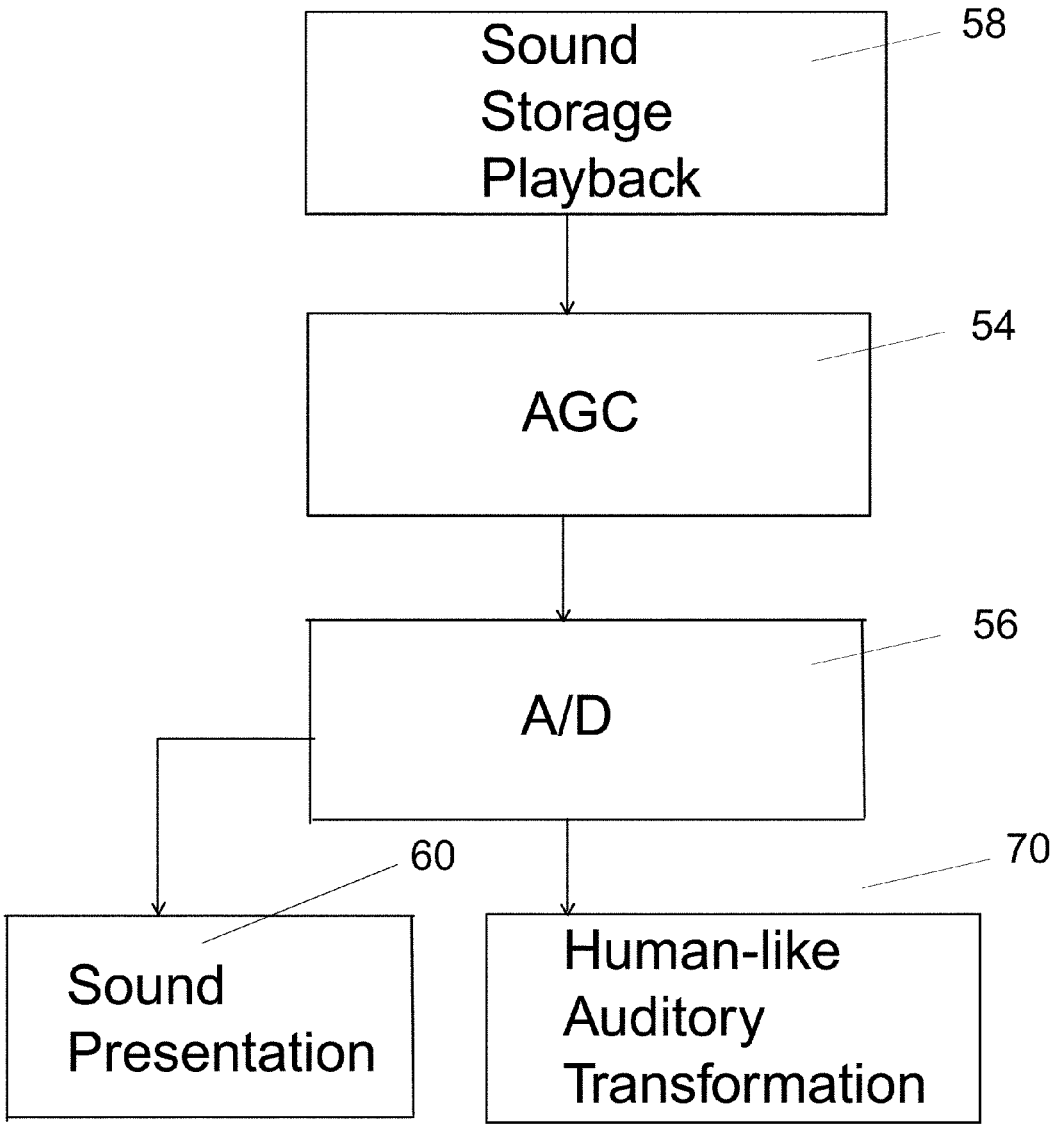
FIG. 3B is a block diagram of the signal reception feature of the device using sound from an analog storage source or a playback device using digital storage but providing an analog output.
Figure 3C:
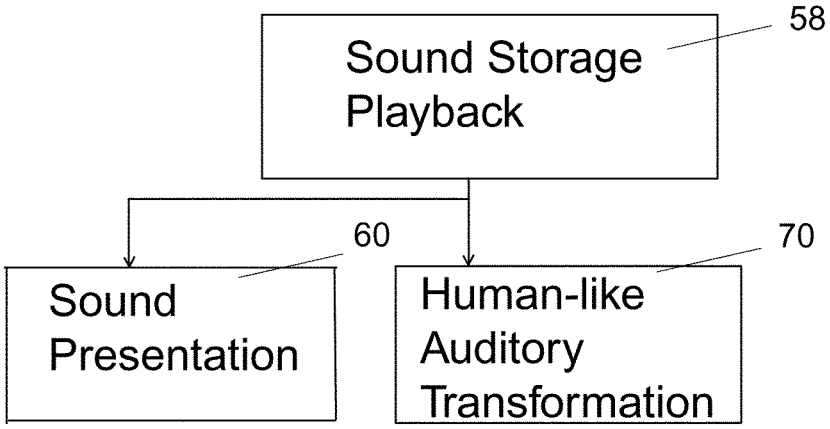
FIG. 3C is a block diagram of the signal reception feature of the device using sound from a digital storage source

The signal detection may be a stored signal, as shown in FIGS. 3B and 3C, derived from an analog or digital electronic sound storage playback (58) device. Examples of such devices are a computer hard drive, a computer floppy disk, a computer flash memory device, a tape, a compact disk, or other storage device. FIG. 3B shows the use of an analog sound storage playback device. The signal is processed by the AGC (54) and the A/D (56) as with the microphone described previously. Digital sound storage playback may be input directly to the human-like auditory transformation (70) as shown in FIG. 3C.

The sound presentation (60) may include a time delay to accommodate some presentation displays (106) that inherently take additional time to be perceived, such as a fireworks display. The signal is processed and provided to the audience through an audio playback device. The device may be integral with the computer operating the presentation software, or a separate device to provide special effects, such as surround sound, or to accommodate multiple sound sources for large audiences, as with a fireworks display.

Figure 7:
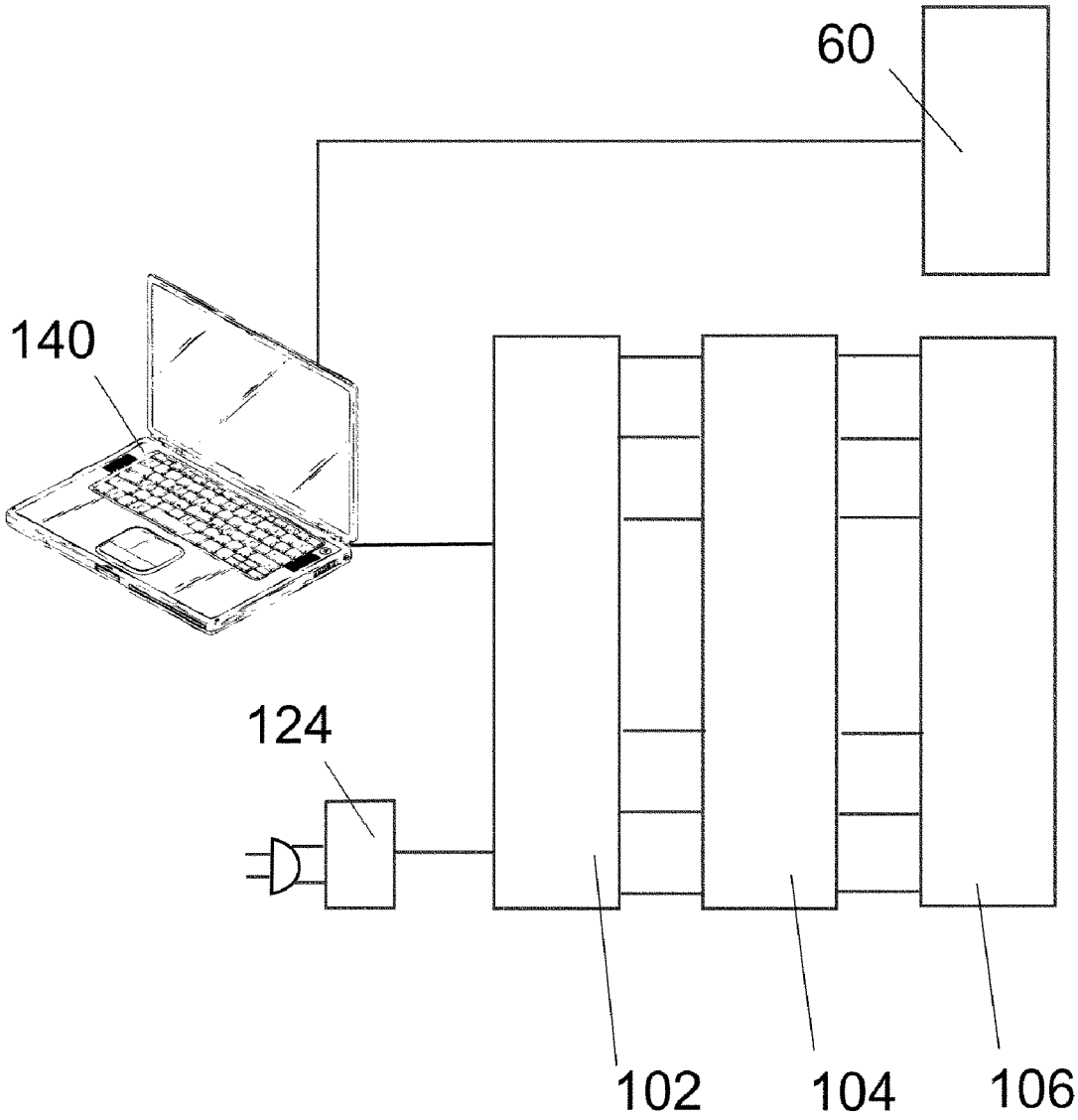
FIG. 7 is a schematic diagram of an implementation of the acoustic presentation system on a general-purpose computer.

A device for any of the visual or tactile presentations with digital sound storage is shown in FIG. 7. The general purpose computer (140) stores digital music files on the hard disk. This sound storage provides a selected signal to be processed by the computer using the instructions of the present invention previously described. The output of this processing is a multichannel digital signal from the computer to the multichannel D/A (102). The multiple analog signals of each channel then go to the presentation actuation (104) that implements the presentation display (106). The selected signal also is output from the computer to the sound presentation (60). The sound presentation (60) and the visual or tactile display (106) may then be perceived by the audience together.

Figure 8:
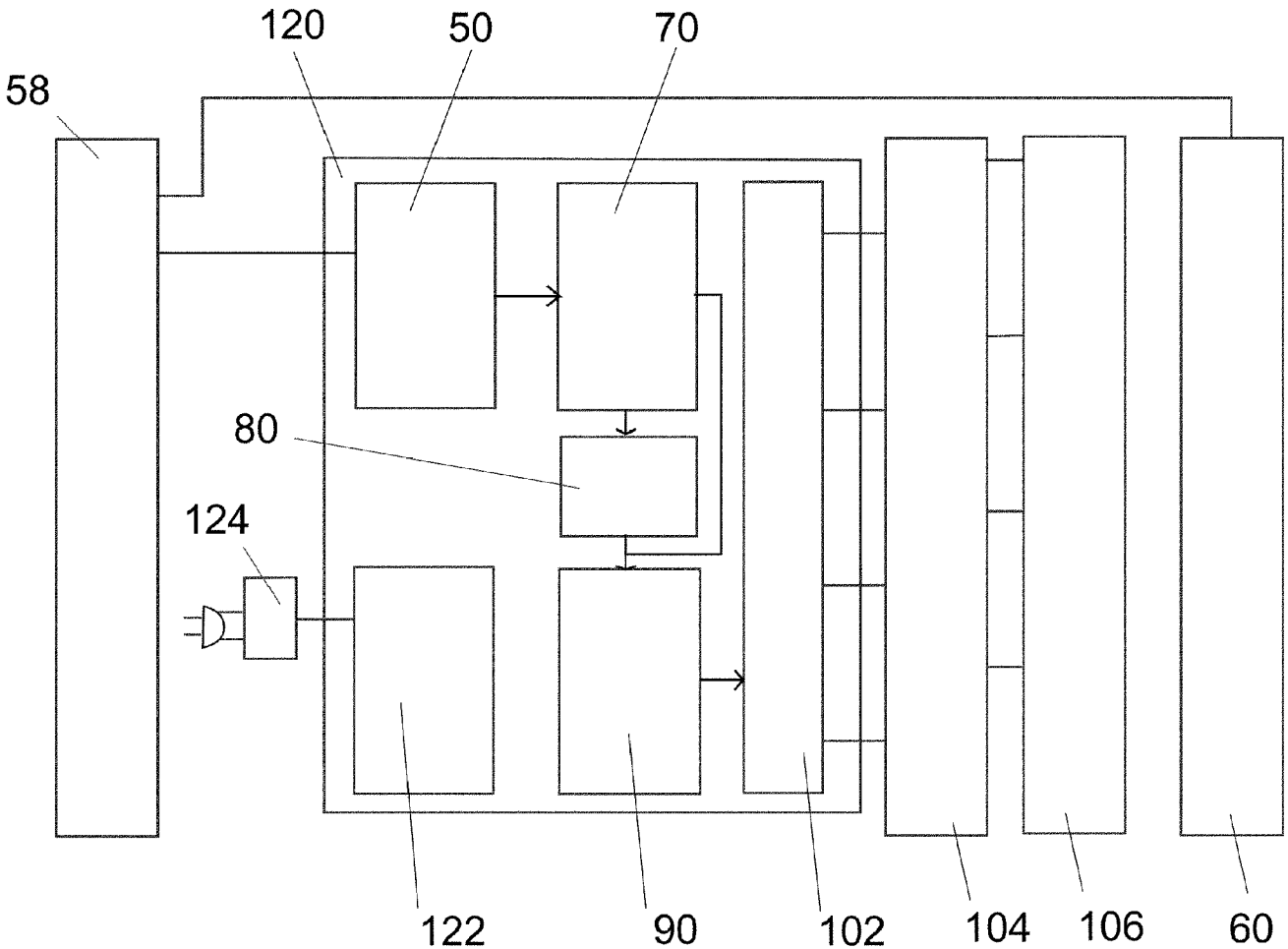
FIG. 8 is a schematic diagram of an implementation of the acoustic presentation system on an ASIC.

A device using an ASIC processor for any of the visual or tactile presentations with sound storage is shown in FIG. 8. A sound storage playback device (58) provides the sound signal to the ASIC (120) and to the sound presentation (60). Processing of the sound signal to produce the visual or tactile presentation display (106) occurs quickly enough so the audience perceives the sound and presentation simultaneously for most presentations. There are some presentations, such as a fireworks display as noted previously, where a time delay for the sound presentation (60) is necessary to provide the perception the presentation display (106) and the sound presentation is simultaneous.

What is claimed is:

1. A system for providing an audience with a visual or tactile presentation representative of perceived sound comprising:

a. a signal reception with a microphone, an AGC circuit and an A/D circuit wherein a digital signal corresponding to the sound is created;

b. a processor instructed to perform a human-like auditory transformation on the digital signal such that a multichannel digital signal is created;

c. the processor further instructed to perform a time-sequence scaling of each channel of the multi-channel digital signal; and d. a presentation with a multi-channel D/A circuit and multi-channel visual or tactile presentation controls such that the presentation provides the audience a visual or tactile presentation representative of the sound.

2. The system for providing an audience a reception of sound and a visual or tactile presentation representative of the sound as in claim 1 further comprising the signal reception uses a sound storage device providing a digital signal corresponding to the sound, and a sound presentation device providing the sound.

3. The system for providing an audience a reception of sound and a visual or tactile presentation representative of the sound as in claim 1 further comprising the signal reception uses a sound storage playback device providing an analog signal corresponding to the sound to the AGC, and a sound presentation device providing the audience the sound.

4. The system for providing an audience a reception of sound and a visual or tactile presentation representative of the sound as in claim 1 further comprising the processor is instructed to perform beat detection and applying the resulting beat component to one or more channels of the multichannel digital signal.

5. The system for providing an audience a reception of sound and a visual or tactile presentation representative of the sound as in claim 1 further comprising the human-like auditory transformation includes a human hearing model selected from the group consisting of critical bands, mel scale, bark scale, equivalent rectangular bandwidth, and just noticeable difference.

6. The system for providing an audience a reception of sound and a visual or tactile presentation representative of the sound as in claim 1 further comprising the processor and processor instructions are an Application Specific Integrated Circuit.

7. The system for providing an audience a reception of sound and a visual or tactile presentation representative of the sound as in claim 1 further comprising the processor and processor instructions are contained in a general-purpose computer.

8. A method of providing a visual or tactile presentation that is representative of the human perception of sounds comprising:

a. receiving an acoustic signal;

b. performing a human-like auditory transformation of the signal such that the signal has multiple channels;

c. time-sequence scaling the transformed signal;

d. providing an audience a visual or tactile presentation of the transformed signal.

9. The method of providing a visual or tactile presentation that is representative of the human perception of sounds as in claim 8 further comprising step a is:

a. selecting an acoustic signal from sound storage playback.

10. The method of providing a visual or tactile presentation that is representative of the human perception of sounds as in claim 8 further comprising step b. is:

b. performing a human-like auditory transformation of the signal such that the signal has multiple channels, determining a beat component, and incorporating the beat component in one or more of the transformed signal channels.

11. A computer-readable medium having computer-executable instructions for performing a method comprising:

a. receiving an acoustic signal;

b. performing a human-like auditory transformation of the signal such that the signal has multiple channels;

c. time-sequence scaling the transformed signal;

d. providing an output signal for audience visual or tactile presentation of the transformed signal.

12. The computer-readable medium having computer-executable instructions for performing a method as in claim 11 further comprising step a. is:

a. selecting an acoustic signal from sound storage playback.

13. The computer-readable medium having computer-executable instructions for performing a method as in claim 11 further comprising step b. is:

b. performing a human-like auditory transformation of the signal such that the signal has multiple channels, determining a beat component, and incorporating the beat component in one or more of the transformed signal channels.

14. A device for providing a visual, or tactile presentation that is representative of the human perception of sounds comprising:

a. means for acoustic signal reception;

b. means for a human-like auditory transformation of the acoustic signal such that the signal has multiple channels;

c. means for time-sequence scaling the transformed signal; and d. means for audience visual or tactile presentation of the transformed signal.

15. The device for providing a visual, or tactile presentation that is representative of the human perception of sounds as in claim 14 further comprising the means for a human-like auditory transformation of the acoustic signal includes means for determining and incorporating a beat component in the transformed signal.

16. The device for providing a visual, or tactile presentation that is representative of the human perception of sounds as in claim 14 further comprising the means for acoustic signal reception is selected from the group comprising a microphone and sound storage playback.

17. The device for providing a visual, or tactile presentation that is representative of the human perception of sounds as in claim 14 further comprising the means for time-sequence scaling the transformed signal is a comparison of the current and the previous time period signal value ranges to a desired range and adjustment of the current value as necessary to maintain the desired range.

18. The device for providing a visual, or tactile presentation that is representative of the human perception of sounds as in claim 14 further comprising the means for a human-like auditory transformation of the acoustic signal is:

a. a device to convert a duration of the received acoustic sound from an analog electrical signal to a digital signal;

b. a device to perform a Fast Fourier Transform of the received acoustic sound; and c. a device for segregating the fast Fourier transform frequency band output into two or more presentation channels using a human hearing model grouping selected from the group consisting of critical bands, mel scale, bark scale, equivalent rectangular bandwidth, and just noticeable difference.

19. The device for providing a visual, or tactile presentation that is representative of the human perception of sounds as in claim 18 further comprising the means for determining and incorporating a beat component in the transformed signal is derived from summing the output of the Fast Fourier Transform of the acoustic signal.

* * * * *